United States Patent [19]

Fernandez et al.

[11] 4,340,294

[45] Jul. 20, 1982

[54] DEVELOPING APPARATUS

[75] Inventors: Avelino Fernandez, Gauting; Josef Glass, Ottobrunn; Viktor Osegowitsch, Taufkirchen, all of Fed. Rep. of Germany

[73] Assignee: Agfa-Gevaert Aktiengesellschaft, Leverkusen, Fed. Rep. of Germany

[21] Appl. No.: 177,464

[22] Filed: Aug. 11, 1980

Related U.S. Application Data

[63] Continuation of Ser. No. 804,848, Jun. 8, 1977, Pat. No. 4,248,515.

[30] Foreign Application Priority Data

Jun. 12, 1976 [DE] Fed. Rep. of Germany ..... 2626447

[51] Int. Cl.[3] ..... G03D 3/13

[52] U.S. Cl. ..... 354/321; 354/322; 134/64 P

[58] Field of Search ..... 354/302, 316, 319, 320, 354/321, 322, 328, 331, 337, 339; 355/10, 27, 100, 106; 134/64 P, 122 P, 83, 125, 126, 154, 165, 182, 183; 118/424, 429, 662

[56] References Cited

U.S. PATENT DOCUMENTS

| | | | |
|---|---|---|---|
| 2,894,440 | 7/1959 | Boger | 354/302 |
| 3,277,808 | 10/1966 | Frohock | 354/302 |
| 3,354,807 | 11/1967 | Horner | 354/328 |
| 3,495,520 | 2/1970 | Schumacher | 354/321 |
| 3,661,067 | 5/1972 | Aarnio | 354/322 |
| 3,694,071 | 9/1972 | Touchette | 354/319 |
| 3,728,954 | 4/1973 | Everett et al. | 354/322 |
| 3,735,689 | 5/1973 | Smola et al. | 354/321 |
| 3,833,918 | 9/1974 | Stievenart | 354/339 |
| 3,839,040 | 10/1974 | Goldstein | 354/321 |
| 3,913,524 | 10/1975 | Fukushima et al. | 118/662 |
| 4,086,607 | 4/1978 | Muller | 354/322 |
| 4,099,194 | 6/1978 | Kummerl | 354/321 |
| 4,123,769 | 10/1978 | Fernandez et al. | 354/322 |

FOREIGN PATENT DOCUMENTS

| | | | |
|---|---|---|---|
| 629748 | 12/1961 | Italy | 354/302 |

*Primary Examiner*—L. T. Hix
*Assistant Examiner*—Alan Mathews
*Attorney, Agent, or Firm*—Michael J. Striker

[57] ABSTRACT

Photographic material to be processed passes generally horizontally through a succession of processing chambers including a developing chamber. The latter includes a developing-fluid tank containing a body of developing fluid, the body of developing fluid having an upper surface. At least one rotatably mounted submerging roller causes transported photographic material to pass below the upper surface of the body of developing fluid. A counterpressure roller presses the transported photographic material against the submerging roller during transport of the photographic material through the developing chamber. Flow elements are arranged to damp the agitation of the body of developing fluid resulting from rotation of the submerging and counterpressure rollers. The submerging and counterpressure rollers are so arranged that the trailing end of transported photographic material does not drag over the peripheral surface of either roller in circumferential-surface contact therewith.

5 Claims, 1 Drawing Figure

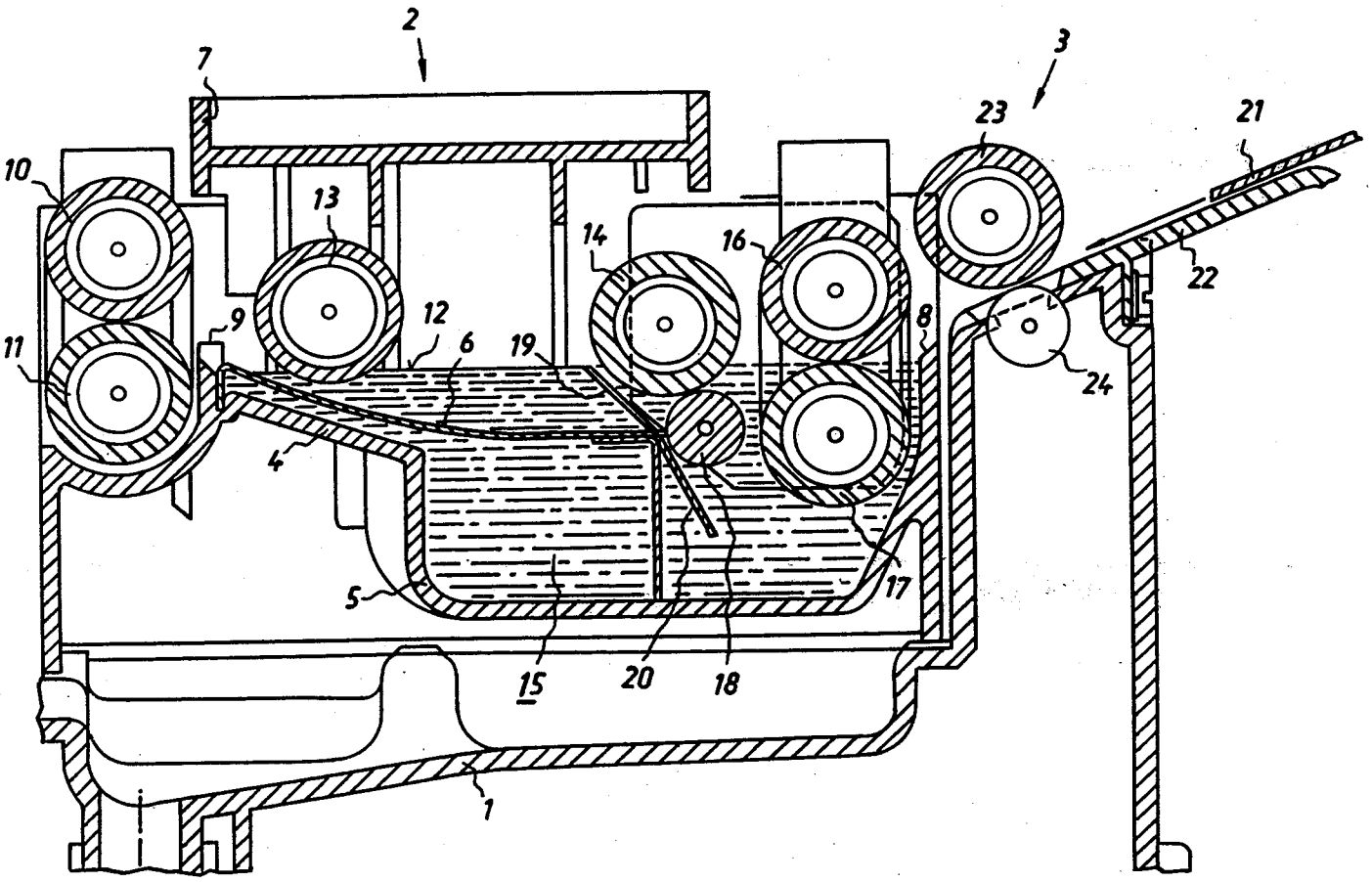
1
2
3
4
5
6
7
8
9
10
11
12
13
14
15
16
17
18
19
20
21
22
23
24

DEVELOPING APPARATUS

This is a continuation of application Ser. No. 804,848, filed June 8, 1977 now U.S. Pat. No. 4,248,515.

BACKGROUND OF THE INVENTION

The invention relates to developing apparatuses for photographic material, particularly photographic sheet material, of the type comprising a succession of processing chambers through which the photographic material successively travels, generally horizontally. Each processing chamber typically includes a tank containing processing fluid, at least one submerging roller for causing transported material to pass below the upper surface of the body of processing fluid in the tank, guide means defining a path of travel through the chamber, with pairs of transport rollers being located intermediate successive chambers for effecting transport of photographic material out of one chamber and into the next.

Developing apparatuses of the type in question are generally used for developing X-ray film or black-white paper, with the first in the succession of processing chambers usually containing a bath of developing fluid.

Typically, this type of developing apparatus is of relatively small dimensions, necessitating a correspondingly low transport speed for the photographic material to be processed. These low transport speeds are quite acceptable when black-white photographic material is being processed, on account of the relative insensitivity of such material. However, the type of developing apparatus in question is not suitable for processing color paper, because even the smallest disturbances in the transport of the photographic material through the developing chamber and likewise even the smallest disturbances of the quiescence of the body of developing fluid, lead to stripy or schlieric effects upon the photographic material.

Also, if all longitudinally successive portions of the transported photographic material are not subjected to identical mechanical stresses during passage through the developing chamber, then the quality or character of the different portions of the material after processing may differ correspondingly.

SUMMARY OF THE INVENTION

It is accordingly a general object of the invention to provide a developing apparatus of the type in question with simple and reliable means which render the developing apparatus capable of satisfactorily processing color paper, too.

According to one concept of the invention, this is achieved by incorporating in the developing chamber a submerging roller which causes the transported photographic material to pass below the upper surface of the body of developing fluid, and by providing a cooperating counterpressure roller which presses the transported photographic material against the submerging roller during transport of the material through the developing chamber. If more than one submerging roller is utilized, then preferably it is at least the first (most upstream) submerging roller which is provided with the cooperating counterpressure roller.

As a result of this expedient, the contact between for example the emulsion of an emulsion carrier and the peripheral surface of the submerging roller, is maintained during the first phase of the development process all the way to the trailing edge of the transported material.

If this counterpressure roller were not employed, then the trailing end of an emulsion carrier or other material, after leaving the infeed rollers of the developing chamber, would descend due to gravity and thereby move out of contact with the peripheral surface of the submerging roller, so that this trailing end portion of the photographic material would pass through the developing-fluid bath uncontacted by the submerging roller—i.e., in contrast to the preceding portion of the material which would be contacted by the submerging roller. As a result, the quality or character of the trailing end portion of the material, after processing, would be different from that of the preceding portion of the material. This would be particularly serious where the photographic material is in sheet form.

According to another concept of the invention, inclined flow plates are provided within the body of developing fluid oriented transverse to the transport direction of the photographic material. These inclined flow plates serve to still the body of developing fluid, e.g., to damp the agitation of the fluid resulting from rotation of the submerging and counterpressure rollers during transport of photographic material. Accordingly, it becomes possible to maintain the relative motion between the body of developing fluid and the transported material extremely low, i.e., the motion of the fluid in the bath relative to the transported material is maintained extremely constant. This makes it possible to achieve very uniform development of color paper in a developing apparatus of the type in question even at low transport speed. Thus, the relatively limited volume of the body of developing fluid in the type of apparatus in question is made sufficient, and the need for a large volume of fluid to achieve equivalent stability (which is anyway unrealizable in the type of limited-dimension apparatus in question) is avoided.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWING

The single FIGURE illustrates an exemplary embodiment of the invention, shown in sectional view.

DESCRIPTION OF THE PREFERRED EMBODIMENT

In the FIGURE, numeral 1 denotes the structural framework of a developing apparatus of the type in question. The developing apparatus includes a succession of processing chambers, arranged for generally horizontal travel of the photographic material to be processed. However, in the FIGURE only the first chamber 2 and the infeed unit 3, of the apparatus is depicted.

Connected to the framework 1 is a developing-fluid tank 4, of rather small dimensions, provided with a portion 5 of greater depth. The tank 4 is covered over at its top by an upper structure 7, on which is dependently mounted a rotatable submerging roller 13. The outfeed end of the chamber 2 is provided with an outfeed slot 9 located between the tank 4 and the upper structure 7.

Downstream of the outfeed slot 9 is a pair of outfeed transport rollers 10, 11. Downstream of rollers 10, 11 is the next processing chamber (not illustrated) of the apparatus.

The infeed end of the chamber 2 is provided with an infeed slot 8, downstream of which is a pair of infeed transport rollers 16, 17.

Downstream of the infeed transport rollers 16, 17 is a first submerging roller 14. Bearing against the peripheral surface of roller 14, at a portion thereof submersed within the bath of developing fluid 15, is a counterpressure roller 18, located in general beneath the submerging roller 14.

Downstream of the cooperating submerging and counterpressure rollers 14, 18 there are provided at the sides of the latter inclined flow plates 19, 20 as well as a guide plate 6. The flow plates 19, 20 serve to damp the agitation of the developing fluid 15 produced by rotation of the submerging and counterpressure rollers 14, 18. The guide plate 6 serves to guide photographic material below the upper surface 12 of the developing fluid 15 during transport of the material through the chamber 2.

The operation of the illustrated embodiment is as follows:

A sheet (or alternatively a strip) of photographic material 21 is fed by the infeed unit 3, comprised of an inclined infeed table 22 and a pair of infeed transport rollers 23, 24, into the infeed slot 8 of the chamber, and thence into between the pair of infeed transport rollers 16, 17. The infeed transport rollers 16, 17 are so positioned that the photographic material 21 is guided underneath the submerging roller 14, and thereby caused to be submerged within the developing fluid 15.

As the photographic material 21 is transported further, it passes between the cooperating submerging roller 14 and counterpressure roller 18, pressed therebetween. Accordingly, during the entirety of the first development phase, the photographic material 21, along its entire length, will be subjected to an unvarying pressing action, thereby avoiding the disadvantages discussed earlier.

Upon further transport of the photographic material 21 by the transport rollers 16, 17, the leading end of the same is guided through the outfeed slot 9 and reaches and enters into between the outfeed transport rollers 10, 11. These then engage the leading end of the material and effect subsequent transport.

It will be understood that, if sheets of photographic material are involved, then the length of each sheet must be greater than the distance between the infeed rollers 16, 17 and the outfeed rollers 10, 11, i.e., if the rollers 14, 18 are not driven rollers. In general, however, it will be clear that for sheet material the dimensions of the developing chamber 2 are relatively small, i.e., on the order of size of the sheet itself, if not smaller, and that the volume of developing fluid 15 which is contained therein is correspondingly limited. Accordingly, the presence of the flow plates 19, 20 serving as they do to damp the agitation of this relatively small volume of fluid 15, resulting inter alia from rotation of rollers 14, 18, is particularly important, and achieves an effect comparable to a larger volume of fluid, such as could not be actually contained within the developing chamber of the type of developing apparatus in question.

Also, the counterpressure roller 18 is located more or less beneath the submerging roller 14. As a result, the zone of engagement between the rollers 14, 18 is so located relative to the transport path of photographic material, and in particular relative to the zone of engagement between outfeed rollers 10, 11, as to preclude differences between the manner in which the trailing end and the preceding portion of the material are engaged by the rollers 14, 18. Specifically, when the leading end of the photographic material 21 begins to be engaged by outfeed rollers 10, 11, and the trailing end leaves infeed rollers 16, 17, the trailing end portion will not be able to drag over the peripheral surface of the submerging roller 14 in circumferential-surface contact therewith. If this expedient were not resorted to, then the trailing end portion could, for example, be subjected to a more prolonged surface contact by submerging roller 14, resulting in a different development factor for the trailing end portion of the material.

It will be understood that each of the elements described above, or two or more together, may also find a useful application in other types of constructions, differing from the types described above.

While the invention has been illustrated and described as embodied in a specific example of the type of developing apparatus in question, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. An improvement to a developing machine for developing color paper susceptible to pressure sensitization while being processed, which has a series of fluid-containing chambers through which the color paper passes along a generally horizontal path, the improvement comprising: a rotatable submerging roller guiding the color paper beneath an upper surface of fluid in a chamber; and a rotatable counterpressure roller located beneath the submerging roller and pressing the color paper uniformly against the submerging roller while the color paper passes along said path, so that the sensitization of the color paper is minimized not by decrease of pressure, but instead by placing the color paper under the uniform pressure.

2. The improvement defined by claim 1, wherein the submerging roller has an outer peripheral surface which is made of rubber.

3. The improvement defined by claim 1, wherein the submerging roller has an outer peripheral surface which is made of synthetic plastic.

4. The improvement defined by claim 1, wherein each of the rollers has an outer peripheral surface, and wherein at least one of the outer peripheral surfaces is made of an elastically yieldable material.

5. The improvement defined by claim 1, further including: a pair of infeed rollers located upstream of the submerging roller and counterpressure roller along said path and guiding the color paper towards the submerging roller and the counterpressure roller; and a pair of outfeed rollers located downstream of the submerging roller and counterpressure roller along said path and guiding the color paper away from the submerging roller and the counterpressure roller, all rollers being so positioned that the submerging roller and the counterpressure roller are closer to the infeed rollers than they are to the outfeed rollers and said path achieves its lowest level intermediate the submerging roller and the counterpressure roller.

* * * * *